United States Patent [19]

Lacke et al.

[11] Patent Number: 4,906,410

[45] Date of Patent: Mar. 6, 1990

[54] FABRIC SOFTENER COMPOSITION FOR AUTOMATIC LAUNDRY DRYER APPLICATIONS

[75] Inventors: Philip M. Lacke, Decatur, Ill.; Jean M. Fink, Linwood, N.J.

[73] Assignee: Sherex Chemical Company, Dublin, Ohio

[21] Appl. No.: 262,502

[22] Filed: Sep. 9, 1988

[30] Foreign Application Priority Data

Dec. 8, 1986 [WO] PCT Int'l Appl. ..... PCT/US86/02632

[51] Int. Cl.[4] ..... D06M 13/46

[52] U.S. Cl. ..... 252/8.8; 8/188; 252/8.6; 252/8.75; 252/8.9

[58] Field of Search ..... 252/8.8, 8.9, 8.75

[56] References Cited

U.S. PATENT DOCUMENTS

| | | | |
|---|---|---|---|
| 3,442,692 | 5/1969 | Gaiser | 8/120 |
| 3,444,090 | 5/1969 | Michal | 252/8.8 |
| 3,492,324 | 1/1970 | Blackman | 252/8.8 |
| 4,058,489 | 11/1977 | Hellsten | 252/8.75 |
| 4,115,281 | 9/1979 | Ciko et al. | 252/8.8 |
| 4,134,840 | 1/1979 | Minegishi et al. | 252/8.9 |
| 4,399,045 | 8/1983 | Burns | 252/8.75 |
| 4,497,716 | 2/1985 | Tai | 252/8.8 |

FOREIGN PATENT DOCUMENTS

| | | |
|---|---|---|
| 60-139753 | 7/1985 | Japan . |
| 61-047877 | 3/1986 | Japan . |

*Primary Examiner*—A. Lionel Clingman

*Attorney, Agent, or Firm*—Scully, Scott, Murphy & Presser

[57] ABSTRACT

A composition comprising between about 30 and 70% by weight of a dialkyldiamido quaternary compound and between about 70 and 30% by weight of a polyoxyalkylene derivative may be coated onto substrates, and the articles thereby obtained are suitable for use as fabric softeners in automatic laundry dryers. The compositions of this invention, when coated onto substrates, are mechanically stable and thus are not dislodged or prematurely released when substrate is flexed or twisted.

29 Claims, No Drawings

FABRIC SOFTENER COMPOSITION FOR AUTOMATIC LAUNDRY DRYER APPLICATIONS

BACKGROUND OF INVENTION

1. Field of Invention

This invention relates to low melting softening compositions for textiles and textile fibers, particularly for use in automatic laundry dryers.

2. Description of the Related Art

The tendency for laundered textile fibers to acquire stiffness and static charges is most pronounced when the laundry product is a synthetic detergent. Stifness of the fibers and static charges combine to impart a palpable harshness to the textile. Articles of clothing, bed linens and the like, possessing such harshness, are irritating to the skin and uncomfortable. In addition, they tend to retain wrinkles and attract dirt and dust. These undesirable consequences of laundering have been overcome by the use of quaternary ammonium compounds, which are widely used to impart softness and pliability to the textile and to diminish static charges. Quaternary compound softeners may be a component of the laundry detergent, may be added separately to the wash water at some point in the laundry cycle, or dispensed in the dryer.

The utility of quaternary salts of dialkyldiamidoamines, especially those derived from fatty acids, as softeners for textile fibers in laundry wash water applications, and a method for their preparation, are set forth in U.S. Pat. No. 3,492,324. This patent teaches that the quaternary compounds are obtained as semi-solids or solids, which are admixed with appropriate quantities of water to form pastes. These pastes, which are "pourable", may then further be admixed with water to form dispersions suitable for incorporation onto textiles and textile fibers for the purpose of softening them.

Incorporation of fabric softening compositions onto textiles or textile fibers may be accomplished by adding an aqueous dispersion of the fabric softening composition to laundry wash or rinse water. The latter method is widely practiced in home laundries. U.S. Pat. No. 3,442,692 teaches that the inherent problem in adding liquid fabric softening compositions to the rinse cycle in home laundries is that residual soap and/or detergent present may interfere with retention of an effective amount of fabric softening composition by the fiber. Because of the restricted solubility of fabric softening compositions, especially quaternary ammonium compounds, the composition of such liquid laundry products is predominantly water or water and solvent. Liquids are by their nature expensive to store and ship, requiring bulky containers.

The problems inherent in bulky liquid fabric softening compositions may be overcome, as taught by e.g. U.S. Pat. No. 3,442,692, by incorporating the fabric softening composition, as a solution or a dispersion, onto a substrate material, from which the water or water and solvent may be evaporated. Examples of such substrate materials include absorbing paper, sponge, woven or felted fabric. A dry substrate, impregnated with fabric softening composition, may then be added directly to the automatic laundry dryer. In the laundry dryer, the combination of water vapor from the wet laundry, heat, and air flow, are sufficient to distribute the fabric softener onto the laundry articles in the dryer. Thus, a convenient, dry, easily stored and handled fabric softening composition, which uniformly and predictably imparts softening to textile or textile fibers, may be prepared.

An improvement in automatic dryer substrate coating technology is described in U.S. Pat. No. 4,137,345 which teaches the advantages of using a porous, dimensionally stable substrate, onto which a molten fabric softening composition may be coated. Thus, the step of removing water and/or solvent from a fabric softening dispersion or solution impregnated on a substrate is eliminated. The step of drying the substrate is time-consuming and could also cause loss of fabric softening composition from the substrate through volatilization. U.S. Pat. No. 4,137,345 also teaches that a rigid, i.e. dimensionally stable, substrate is preferred, since there will be a marked tendency for a flexible substrate to lose its coating of fabric softening composition through flexure. That is, as the flexible substrate bends and twists within the rotating drum of the automatic laundry dryer, the fabric softening composition on its surface tends to crack, peel, and fall off. The coating of fabric softening compositions onto rigid substrates may be achieved by using fabric softening compositions in the preferred melting range of 60°-90° C.

The melting range of dialkyldiamido quaternary compounds of this invention, such as those described in U.S. Pat. No. 3,492,324, is approximately 95° to 105° C. Moreover, these dialkyldiamido quaternary compounds tend to form friable solids when dried, and thus would not be expected to adhere to a flexible substrate. The viscosity of the dialkyldiamido quaternary compounds of this invention have been measured at 160,000 centipoises at 120° C., which render physically coating onto a substrate difficult. Once coated onto a substrate, dialkyldiamido quaternary compounds would not uniformly or readily be released by the substrate under the conditions existing in automatic laundry dryers. Although dialkyldiamido quaternary ammonium compounds function well as fabric softeners when added to the laundry wash or rinse water, as is known in the art, their physical properties, as set forth above, preclude their direct use in laundry dryers.

SUMMARY OF THE INVENTION

It has been discovered that dialkyldiamido quaternary compounds in combination with a polyoxyalkylene derivative may readily be coated directly onto a flexible substrate, and may be released from that substrate evenly and predictably under conditions existing in automatic laundry dryers.

The present invention is directed to a low melting fabric softening composition suitable for use in automatic laundry dryers. Such a composition may be obtained by admixing a neat dialkyldiamido amine quaternary fabric softening compound with a polyoxyalkylene derivative, in appropriate proportions to obtain a mixture which melts at about 50° C. This composition in a molten state then may be conveniently coated onto a flexible substrate. Exposure of the coated substrate to the environment existing in automatic laundry dryers (heat, water vapor, air flow) results in the uniform release of sufficient fabric softening composition, by contact and volatilization, to soften the laundered articles. Compositions of this invention permit the coating of essentially solvent free dialkyldiamidoamine quaternary fabric softeners onto flexible substrates. Flexing of the substrate does not result in uncontrolled release of fabric softening composition by cracking or peeling.

Release of fabric softening composition from the substrate occurs solely in the environment of the automatic laundry dryer.

Thus, the composition of this invention overcomes the problems of mechanical instability (e.g. flaking, peeling) associated with the use of dialkyldiamido quaternary ammonium compounds to coat flexible substrates. The problems associated with coating solutions or dispersions of dialkyldiamido quaternary compounds which include the necessity for bulky storage and shipping containers, non-uniform deposition of quaternary compound, and losses thereof due to drying of the coated substrate, are also overcome.

DETAILED DESCRIPTION OF THE INVENTION

It has been discovered that by admixing an effective percentage, up to 70% by weight, of a polyoxyalkylene nonionic surfactant with at least 30% by weight of dialkyldiamido quaternary compounds, a fabric softening composition suitable for use in automatic laundry dryers may be obtained. The addition of the polyoxyalkylene nonionic surfactant significantly reduces the melting range and viscosity of the dialkyldiamido quaternary compound, facilitating coating the mixture onto substrate materials. It has also been discovered that when mixtures of dialkyldiamido quaternary compounds and polyoxyalkylene nonionic surfactants are coated onto flexible substrates at relatively low temperatures, i.e., 50°-70° C., the coating is mechanically stable. Upon flexing the substrate, no particulate of the coating of the composition of this invention separates from the substrate.

It has further been discovered that the fabric softening efficacy of dialkyldiamido quaternary combined with polyoxyalkylene nonionic surfactants is at least equal to commercial fabric softeners on substrates currently marketed for use in automatic dryers. Such commercially marketed fabric softening products are treated with combinations of di(hardened tallow) methylammonium sulfate and nonionic detergents, among others. The compositions of this invention, however, contain significantly lower quantities of quaternary fabric softening compounds than the commercially available dryer fabric softeners used as controls, yet provide at least equal fabric softening effect, in the dryer.

The dialkyldiamido quaternary ammonium compound of this invention may be prepared from fatty acids, derived either from synthetic or natural sources, according to the teachings of U.S. Pat. No. 3,492,324. The fatty acids derived from natural sources contain chain lengths from $C_8$ to $C_{22}$ and mixtures thereof. Thus, fatty acids can be reacted with dialkylenetriamine in a mole ratio of 2:1, the resulting dialkyldiamidoamine was methylated by reaction with formic acid and/or formaldehyde, and the resulting dialkyldiamidoalkyl methylamine quaternized with conventional reagents, e.g., dimethyl sulfate. It is well known in the art relating to the quaternization of amines that benzyl chloride, methyl chloride, and dimethylsulfate are suitable quaternizing agents for tertiary amines, such as the dialkyldiamido methylamine described above. Further, it is also well known in the art that methyl chloride may be reacted with secondary amines such as the dialkyldiamido amine described above in a mole ratio of 2:1 respectively, to produce a quaternary compound useful for fabric softening.

The dialkyldiamido quaternary ammonium thus produced has the general formula

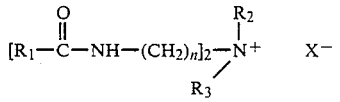

where $R_1$ is a $C_6$ to $C_{22}$ alkyl group or mixture thereof;

$R_2$ is a $C_1$ to $C_3$ alkyl group;

$R_3$ is a $C_1$ to $C_3$ alkyl group, a phenyl group, or a benzyl group, n is 1 to 6;

$X^-$ is a monovalent anionic residue of an alkylating agent; and is obtained as a paste or dispersion.

The quaternary ammonium compounds of this invention may be obtained as a solid by evaporatively removing water and/or solvent. The preferred quaternary ammonium compound of this invention may be produced from hardened tallow fatty acids and diethylenetriamine as is set forth in Example 1, below.

The polyoxyalkylene nonionic surfactant of this invention may be prepared from fatty acids derived either from natural or synthetic sources. The fatty acids may have chain lengths from $C_8$ to $C_{22}$ or mixtures thereof. They may be prepared, as is well known in the art, by condensing fatty acids with hydroxylated compounds such as glycols, ethoxylates and the like, and have the general formula;

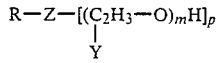

where R is a $C_8$ to $C_{22}$ alkyl group or mixtures thereof; Z is a carboxyl group, oxygen or nitrogen; Y is a hydrogen or methyl group; m is 1 to 12 and p is 1 or 2.

Nonionic polyoxyalkylene derivatives which have been shown to be advantageous for coating dialkyldiamido quaternary compounds onto substrates include the adduct of tallow-derived fatty alcohol with 10 moles of a 5:1 mixture of ethylene oxide and propylene oxide; the adduct of hardened tallow fatty acids with 5 moles of ethylene oxide; the adduct of predominantly stearic acid with 2.75 moles of ethylene oxide; the adduct of predominantly stearic acid with 2.5 moles of a 3:1 mixture of ethylene oxide and propylene oxide.

The polyoxyalkylene nonionic surfactant that has been found most advantageous for this purpose is the condensation product of one mole of predominantly C16 fatty acids (e.g. Hydrofol Acid 1655, Sherex Chemical Company, Dublin, Ohio) with one mole of polyethylene glycol having an average molecular weight of 200. The preferred amount of the polyoxyalkylene derivative is 55% by weight of the fabric softening composition. More or less polyoxyalkylene nonionic may be effective: from about 30% to about 70% by weight. More than these amounts tend to significantly reduce fabric softening effect, and produce an unsuitably fluid coating on the substrate. Such a coating would tend to be too quickly released from the substrate in the dryer, resulting in nonuniform deposition of fabric softening composition and staining of the laundry articles. Less than these amounts of polyoxyalkylene nonionic detergent produce a mechanically unstable coating which would tend to separate from the substrate on flexure, resulting in uneven and unpredictable softening in the laundry dryer.

To illustrate the efficacy of this invention the following nonlimiting examples are set forth.

EXAMPLE 1

Dialkyldiamidoethyl methylammonium metholsulfate may be prepared from hardened tallow fatty acids essentially following the teachings of U.S. Pat. No. 3,492,324. Thus, hardened tallow fatty acids were heated to 100° C. in a vessel equipped with means for agitation and removal of water of reaction. Diethylenetriamine, in a mole ratio of 1 mole of amine to 1.9 moles of fatty acids, was added with agitation to the molten fatty acid. The reaction mixture was then heated to approximately 185° C. and held at that temperature until the stoichiometric quantity of water was evolved, which required several hours. The reaction product, di(hard tallow) amide of diethylene triamine, was cooled to approximately 115° C. under a nitrogen blanket. Over approximately one-half hour, 4 moles of formic acid as a 98% solution, were added with agitation for each mole of amide. The reaction mixture was cooled to approximately 70° C., and one mole of powdered paraformaldehyde per mole of amide was added. The reaction mixture was heated with agitation under reflux at 70° C. for approximately two hours, and then at 110° C. for an additional two hours. Toluene as a diluent was then added and residual water and excess formaldehyde were removed by azeotropic distillation. The reaction mixture was treated with aqueous caustic soda until just slightly basic, then filtered.

The product, N-methyl di(hard tallow) amido derivative of diethylene triamine, was isolated by evaporatively removing the toluene diluent under vacuum, and quaternized neat with dimethyl sulfate. Solid di(hard tallow) diamido methyl ammonium methosulfate was thus obtained.

EXAMPLE 2

Polyoxyalkylene nonionic surfactants may be produced by means well known to the art. Thus in an appropriate vessel equipped with an agitator and means for removal of water of condensation under reduced pressure, one mole of polyethylene glycol with an average molecular weight of 200 was reacted with one mole of predominantly $C_{16}$ fatty acids (Hydrofol Acid 1655, Sherex Chemical Company, Dublin, Ohio) at 100° to 120° C., in the presence of a catalytic quantity of p-toluene sulfonic acid. The pressure was gradually reduced in the vessel to about 20 mm of mercury, and water of condensation removed continually with the aid of a nitrogen sparge. When the acid value of the reaction mixture reached 5 or less, the pH of the mixture was adjusted to between 4 and 6 with aqueous sodium carbonate as a 10% solution. Water was removed by distillation at reduced pressure, and the resulting condensation product filtered to remove residual sodium salts, to yield a polyoxyalkylene nonionic surfactant suitable for use in this invention.

EXAMPLE 3

The quaternary ammonium compounds of Example 1 were admixed with nonionic surfactants in the proportions indicated in Table I below, stirred until uniform at 65°-90° C., and allowed to cool to room temperature to produce softening compositions of this invention. The melting points of these compositions were determined on a Fisher-Johns melting point apparatus (Fisher Scientific Co., Pittsburgh, Pa.). Thus, 0.1 to 0.5 grams of said composition were placed on a cover glass on the hot stage of said melting point apparatus. Another cover glass was placed on top and the hot stage heated at a rate of approximately 2° C. per minute. Heating was continued until the solid melted and flowed, at which point the temperature was recorded as the melting temperature. These data are also presented in Table 1, below.

TABLE 1

| Composition | Ratio Quat.: Nonionic | Nonionic Surfactant | Melting Point (°C.) |
|---|---|---|---|
| 28-5 | 45:55 | Ex. 2 | 48.0 |
| 28-4 | 50:50 | Ex. 2 | 49.0 |
| 28-3 | 60:40 | Ex. 2 | 51.0 |
| 28-2 | 65:35 | Ex. 2 | 52.0 |
| 28-1 | 70:30 | Ex. 2 | 55.0 |
| 91-1 | 40:60 | 84–164(1) | 52.5 |
| 91-2 | 50:50 | Varonic ® U205(2) | 48.0 |
| 91-3 | 50:50 | 69–21(3) | 51.0 |
| 91-4 | 40:60 | 194–38(4) | 50.0 |

(1)Adduct of tallow alcohol (Adol 42, Sherex Chemical Co., Dublin, OH) with 10 moles of a 5:1 mixture of ethylene oxide and propylene oxide.
(2)Adduct of hardened tallow amine with 5 moles of ethylene oxide
(3)Adduct of predominantly stearic acid (Hydrofol Acid 1870; Sherex Chemical Co., Dublin, OH) with 2.75 moles of ethylene oxide.
(4)Adduct of predominantly stearic acid (Hydrofol Acid 1865; Sherex Chemical Co., Dublin OH) with 2.5 moles of a 3:1 mixture of ethylene oxide and propylene oxide.

EXAMPLE 4

The respective fabric softening compositions set forth in Table 1 above, were coated onto 5.1×20.3 cm substrate sheets of nonwoven polyester fiber; woven rayon fiber; and sponge fabric of approximately 0.3 cm thickness. Thus, a portion of the fabric softener mixture was placed on a stainless steel platen heated to 60°-65° C. A thin layer of molten fabric softening mixture was drawn down onto the substrate sheet on the heated platen by rolling a precision machine grooved roller through the molten fabric softener mixture and onto the substrate sheet. The substrate was removed from the heated platen, and the coated fabric softening composition was allowed to cool to room temperature, approximately 22° C. The substrate sheets retained their flexibility, and in no case was there evidence of fabric softening composition separating when the substrate sheet was flexed.

The amount of fabric softening composition deposited on the subtrate sheet was determined by weighing the substrate sheet before and after coating.

COATING WEIGHT DATA

The weight of the coating for each of the substrates was determined by weighing each sheet before and after coating. The weight of coating for the commercially available laundry dryer sheets, used as experimental controls, was found by extraction of the sheets with isopropanol, and determining their respective weight losses. These data are presented in Table 2, below.

TABLE 2

| | Fabric Softening Content of Substrates | | | |
|---|---|---|---|---|
| Substrate | Softening Composition* | Weight Substrate plus Softener (gm) | Weight Substrate (gm) | Weight Softening Composition (gm) |
| Polyester | 28-5 | 3.24 | 1.33 | 1.91 |
| " | 28-4 | 3.23 | 1.37 | 1.86 |
| " | 28-3 | 3.16 | 1.34 | 1.82 |
| " | 28-2 | 3.27 | 1.33 | 1.94 |
| " | 28-1 | 3.23 | 1.30 | 1.93 |
| " | 91-1 | 3.24 | 1.22 | 2.02 |

TABLE 2-continued

| Fabric Softening Content of Substrates | | | | |
|---|---|---|---|---|
| Substrate | Softening Composition* | Weight Substrate plus Softener (gm) | Weight Substrate (gm) | Weight Softening Composition (gm) |
| " | 91-2 | 3.33 | 1.25 | 2.12 |
| " | 91-3 | 3.23 | 1.25 | 1.98 |
| " | 91-4 | 3.24 | 1.26 | 1.98 |
| Rayon | 28-5 | 3.42 | 1.35 | 2.07 |
| " | 28-4 | 3.44 | 1.35 | 2.09 |
| " | 28-3 | 3.52 | 1.40 | 2.12 |
| " | 28-2 | 3.47 | 1.35 | 2.12 |
| " | 28-1 | 3.57 | 1.40 | 2.17 |
| Sponge | 28-5 | 2.45 | 0.63 | 1.82 |
| " | 28-4 | 2.44 | 0.61 | 1.83 |
| " | 28-3 | 2.38 | 0.60 | 1.78 |
| " | 28-2 | 2.39 | 0.60 | 1.79 |
| " | 28-1 | 2.42 | 0.61 | 1.81 |
| Control #1(1) | (3) | 3.39 | 1.36 | 2.03 |
| Control #2(2) | (3) | 2.18 | 0.54 | 1.64 |
| Control #1(1) | (3) | 3.45 | 1.54 | 1.91 |
| Control #2(2) | (3) | 3.83 | 1.66 | 2.17 |

(1)Commercially available rayon substrate dryer softener
(2)Commercially available sponge substrage dryer softener
(3)Di(hard tallow)dimethyl ammonium sulfate plus approximately 30% nonionic
*Composition as per Table 1

EXAMPLE 5

A standardized wash load composed of towels and sheets, previously stripped of fabric treatment chemicals, was used to evaluate the efficacy of the respective coated substrates by drying the wash load with the coated substrate in an automatic laundry dryer. Thus, a standard wash load composed of four white cotton terry cloth towels approximately 38×66 cm. (Cannon Mills Co., New York, N.Y.) and three white cotton percale twin size sheets (65% cotton, 35% polyester, weighing a total of approximately 2500 grams, was washed with 55 grams of standard detergent (AATCC #124, American Association of Textile Chemists and Colorists, Research Triangle Park, N.C.) for six minutes at 40° C. in an automatic washer. The load was rinsed at 35° C. and spin dried. The wash load was transferred to an automatic dryer and dried on high heat along with a coated substrate at approximately 65° C., for 45 minutes. The coated substrate was weighed before and after drying and the percentage loss, i.e. fabric softening composition released from the substrate, was determined.

The dry towels along with controls were submitted to an 8 member panel for ranking by softness to the touch. Each set of towels was evaluated twice by each panelist for softness of feel, care being taken to expose new surfaces between evaluations by refolding the towels. The panelists were, of course, unaware of the identity of fabric softener used, and the relative positions of the towels were randomized. The panel evaluations of tactile softness are presented in Table 3, below.

TABLE 3

| Panel Evaluation of Fabric Softening | | | | |
|---|---|---|---|---|
| Substrate | Fabric Softening Composition* | Softness Test 1 | Softness Test 2 | Average Softness |
| Polyester | 28-5 | 2.4 | 2.1 | 2.2 |
| " | 28-4 | 2.6 | 3.0 | 2.8 |
| " | 28-3 | 2.4 | 2.1 | 2.2 |
| Control #1 | | 2.6 | 2.8 | 2.7 |
| Polyester | 91-1 | 2.5 | 2.4 | 2.4 |
| " | 91-2 | 4.5 | 3.9 | 4.2 |
| " | 91-3 | 2.1 | 1.9 | 2.0 |
| " | 91-4 | 3.1 | 3.3 | 3.2 |
| Control #1 | | 2.8 | 3.6 | 3.2 |
| Rayon | 28-5 | 3.4 | 3.5 | 3.5 |
| " | 28-4 | 2.4 | 1.9 | 2.2 |
| " | 28-3 | 1.4 | 1.6 | 1.5 |
| Control #1 | | 2.9 | 3.0 | 3.0 |
| Sponge | 28-5 | 2.25 | 2.75 | 2.5 |
| " | 28-4 | 3.0 | 2.1 | 2.6 |
| " | 28-3 | 2.7 | 2.25 | 2.5 |
| Control #2 | | 2.1 | 2.9 | 2.5 |

(1) 4 is softest, 1 is harshest - values are averages of 8 panelists.
*As per Table 1

EVALUATION OF FABRIC SOFTENING COMPOSITIONS

Although the amount of fabric softening composition of this invention on the substrates is significantly lower than that of the commercial reference materials, (See Table 2), their respective effects on tactile softness are comparable. The softening compositions of this invention are therefore more efficient than the commercial materials with which they were compared.

EXAMPLE 6

Procedures set forth in Example 5 for laundering and drying a standardized wash load were followed for each coated substrate. However, during the 45 minute dryer cycle, the substrates were each removed at 5 minute intervals and weighted in order to determine the rate of release or retention of fabric softening composition by the substrates. The data obtained by this procedure for each substrate type are presented in Tables 4a, 4b, and 4c, below.

TABLE 4a

| Percent Fabric Softening Composition* Retained by Nonwoven Polyester Substrate | | | | | | | | | | | |
|---|---|---|---|---|---|---|---|---|---|---|---|
| Elapsed Time (min.) | Control #1 | 28-5 | 28-4 | 28-3 | 28-2 | 28-1 | Control #1 | 91-1 | 91-2 | 91-3 | 91-4 |
| 0 | 100 | 100 | 100 | 100 | 100 | 100 | 100 | 100 | 100 | 100 | 100 |
| 5 | 83.3 | 85.9 | 94.7 | 92.9 | 90.2 | — | 84.3 | 93.6 | — | 99.4 | 80.8 |
| 10 | 60.6 | 68.1 | 78.0 | 89.6 | 89.7 | 95.1 | 56.2 | 83.7 | 87.5 | 92.4 | 68.2 |
| 15 | 46.7 | 58.6 | 67.4 | 83.6 | 88.1 | 85.2 | 50.7 | 64.9 | 79.8 | 78.8 | 61.1 |
| 20 | 41.9 | 49.2 | 56.8 | 70.5 | 73.2 | 76.0 | 47.0 | 55.0 | 59.6 | 66.2 | 55.6 |
| 25 | 37.4 | 44.0 | 49.5 | 62.3 | 64.9 | 66.1 | 42.9 | 42.1 | 49.5 | 56.6 | 48.0 |
| 30 | 34.0 | 37.2 | 43.2 | 56.8 | 56.2 | 60.6 | 40.6 | 39.6 | 45.2 | 44.9 | 48.0 |
| 35 | 32.5 | 31.0 | 36.8 | 49.7 | 52.1 | 56.8 | 35.5 | 37.1 | 33.2 | 39.4 | 34.3 |
| 40 | 30.5 | 26.7 | 33.7 | 44.8 | 49.0 | 51.9 | 35.0 | 33.2 | 32.7 | 39.4 | 30.3 |
| 45 | 28.5 | 24.1 | 30.5 | 41.5 | 44.8 | 48.1 | 18.9 | 29.2 | 31.7 | 34.3 | 27.8 |

*Composition as per Table 1

TABLE 4b

| % Retained Elapsed Time (min) | Percent Fabric Softening Composition* Retained by Rayon Substrate | | | | | |
|---|---|---|---|---|---|---|
| | Control #1 | 28-5 | 28-4 | 28-3 | 28-2 | 28-1 |
| 0 | 100 | 100 | 100 | 100 | 100 | 100 |
| 5 | 64.4 | 96.1 | 96.7 | 95.7 | 100 | 97.2 |
| 10 | 52.4 | 85.1 | 88.0 | 87.7 | 100 | 94.0 |
| 15 | 37.2 | 72.5 | 74.2 | 74.4 | 84.0 | 80.7 |
| 20 | 31.9 | 62.3 | 63.2 | 65.4 | 72.2 | 75.6 |
| 25 | 27.2 | 55.1 | 53.6 | 59.7 | 67.0 | 69.6 |
| 30 | 23.0 | 47.8 | 48.8 | 54.5 | 62.3 | 66.8 |
| 35 | 20.9 | 41.6 | 43.5 | 49.3 | 56.6 | 60.4 |
| 40 | 18.3 | 37.1 | 40.7 | 45.0 | 51.4 | 55.8 |
| 45 | 16.8 | 32.4 | 37.3 | 42.2 | 47.2 | 51.6 |

TABLE 4c

| % Retained Elapsed Time (min) | Percent Fabric Softening Composition Retained by Foam Substrate | | | | | |
|---|---|---|---|---|---|---|
| | Control #2 | 28-5 | 28-4 | 28-3 | 28-2 | 28-1 |
| 0 | 100 | 100 | 100 | 100 | 100 | 100 |
| 5 | 82.3 | 93.5 | 99.5 | 85.4 | 90.0 | 90.6 |
| 10 | 59.8 | 84.3 | 87.5 | 78.7 | 80.6 | 88.4 |
| 15 | 51.2 | 74.6 | 87.0 | 78.7 | 83.3 | 79.0 |
| 20 | 49.4 | 69.2 | 81.0 | 69.7 | 68.3 | 72.4 |
| 25 | 42.1 | 60.5 | 70.7 | 61.8 | 63.9 | 69.1 |
| 30 | 39.6 | 51.9 | 61.4 | 54.9 | 60.0 | 64.6 |
| 35 | 37.2 | 48.1 | 57.1 | 50.0 | 54.4 | 63.0 |
| 40 | 35.4 | 44.9 | 54.9 | 47.2 | 51.7 | 58.0 |
| 45 | 34.2 | 42.2 | 51.6 | 44.4 | 49.4 | 56.8 |

*Composition as per Table 1

RETENTION DATA

In order for softening to occur, the fabric softening composition must migrate from the substrate to the fibers of the laundered articles. Softening depends not only on the total amount of fabric softening composition coated on the substrate, but also on the rate at which the fabric softening composition is released from the substrate. Thus, the most effective softening will occur when fabric softening compositions are released from the substrate at a constant rate during the course of the dryer cycle. The rate of release of fabric softening composition may be determined by noting the rate of weight loss of the substrate during the dryer cycle. Release of fabric softening composition or loss of weight of the substrate at a constant rate during the course of the dryer cycle permits the laundered articles to become uniformly exposed to fabric softening composition, thus maximizing the fabric softening effect. The rate of release (or rate of retention) of fabric softening compositions of this invention can be seen from Tables 4a, 4b, and 4c, to be more uniform throughout the dryer cycle than that of the commercial reference materials. Thus, the compositions of this inventioon tend to deposit fabric softening composition in a uniform manner onto the fabric, minimizing staining and non-uniform softening of the laundry articles.

We claim:

1. A fabric softening composition for use in automatic laundry dryers characterized by a homogeneous blend of between about 30 and 70 percent by weight of a dialkyldiamido quaternary compound of the general formula

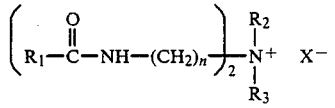

where:

$R_1$ is a $C_6$–$C_{22}$ alkyl group $R_2$ is a $C_1$–$C_3$ alkyl group $R_3$ is a $C_1$–$C_3$ alkyl group, a phenyl group or a benzyl group, n is 1–6, $X^-$ is a monovalent anionic residue of an alkylating agent, and between about 70 and 30 percent by weight of a polyoxyalkylene derivative of the general formula

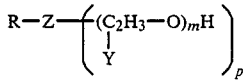

where:

R is a $C_6$–$C_{22}$ alkyl group or mixtures thereof,

Z is a

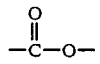

group, oxygen or nitrogen,

Y is hydrogen or a methyl group,

M is 1–12, p is 1 or 2, said blend having a melting range of between 35° and 65° C.

2. The composition of claim 1 wherein n is 4 and $R_1$ is $C_{15}$, and X is a methosulfate radical.

3. The composition as in claim 1 wherein $R_1$ is $C_{17}$, n is 4 and X is a methosulfate radical.

4. The composition as is claim 1 where $R_1$ is $C_{17}$ and X is a chloride radical.

5. The composition as in claim 1 where $R_1$ is $C_{14}$–$C_{22}$ and X is a methosulfate radical.

6. The composition as in claim 3 where the polyoxyalkylene derivative is the adduct of polyethylene glycol with a molecular weight of 200 and a fatty acid mixture containing at least 55% $C_{16}$ fatty acid.

7. The composition as in claim 3 where the polyoxyalkylene derivitive is the adduct of soft tallow alcohol and 10 moles of ethylene oxide.

8. The composition as in claim 3 where the polyoxyalkylene derivative is the adduct of hard tallow amine and 5 moles of ethylene oxide.

9. The composition as in claim 3 where the polyoxyalkylene derivative is the adduct of a fatty acid mixtue containing at least 70 percent $C_{18}$ fatty acid and 2.75 moles of ethylene oxide.

10. The composition as in claim 3 where the polyoxyalkylene derivative is the adduct of a fatty acid mixture containing at least 65% of $C_{18}$ fatty acid and 2.5 moles of a mixture of 3 parts ethylene oxide and one part propylene oxide.

11. The composition as in claim 5 where the polyoxyalkylene derivative is the adduct of polyethylene glycol with a molecular weight of 200 and a fatty acid mixture containing at least 55% $C_{16}$ fatty acid.

12. The composition as in claim 11 where the polyoxyalkylene derivative is present at 55% by weight.

13. The composition as in claim 11 where the polyoxyalkylene derivative is present at 50% by weight.

14. A fabric softening article comprising a substrate, coated with a fabric softening composition comprising a homogeneous blend of between about 30 and 70 percent by weight of a dialkyldiamido quaternary compound of the general formula

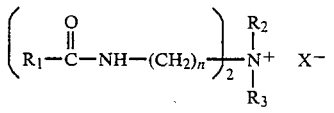

where:

$R_1$ is a $C_6$–$C_{22}$ alkyl group $R_2$ is a $C_1$–$C_3$ alkyl group $R_3$ is a $C_1$–$C_3$ alkyl group, a phenyl group or a benzyl group, n is 1–6, $X^-$ is a monovalent anionic residue of an alkylating agent, and between about 70 and 30 percent by weight of a polyoxyalkylene derivative of the general formula

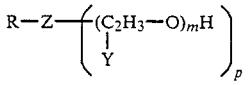

where:

R is a $C_6$–$C_{22}$ alkyl group or mixtures thereof,

Z is a

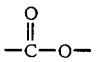

group, oxygen or nitrogen,

Y is hydrogen or a methyl group, m is 1–12, p is 1 or 2, said blend having a melting range of between 35° and 65° C.

15. The fabric softening article as in claim 14, where the substrate is non-woven polyester fabric.

16. The fabric softening article as in claim 14, where the substrate is a woven rayon fabric.

17. The fabric softening article as in claim 14, where the substrate is a sponge fabric.

18. The fabric softening article as in claim 14, wherein the quaternary compound component of the fabric softening composition thereof is such that n is 4, R is $C_{15}$, and X is a methosulfate radical.

19. The fabric softening article as in claim 14, wherein the quaternary compound component of the fabric softening composition thereof is such that n is 4, $R_1$ is $C_{17}$, and X is a methosulate radical.

20. The fabric softening article as in claim 14, wherein the quaternary compound component of the fabric softening composition thereof is such that $R_1$ is $C_{14}$–$C_{22}$ and X is a methosulfate radical.

21. The fabric softening article as in claim 14, wherein the quaternary compound component of the fabric softening composition thereof is such that $R_1$ is $C_{17}$ and X is a chloride radical.

22. The fabric softening article as in claim 19, wherein the polyoxyalkylene derivative component of the fabric softening composition thereof is the adduct of polyethylene glycol with a molecular weight of 200 and a fatty acid mixture containing at least 55% $C_{16}$ fatty acid.

23. The fabric softening article as in claim 19, wherein the polyoxyalkylene derivative component of the fabric softening composition thereof is the adduct of soft tallow alcohol and 10 moles of ethylene oxide.

24. The fabric softening article as in claim 19, wherein the polyoxyalkylene derivative component of the fabric softening composition thereof is the adduct of hard tallow amine and 5 moles of ethylene oxide.

25. The fabric softening article as in claim 19, wherein the polyoxyalkylene derivative component of the fabric softening composition thereof is the adduct of a fatty acid mixtue containing at least 70 percent $C_{18}$ fatty acid and 2.75 moles of ethylene oxide.

26. The fabric softening article as in claim 19, wherein the polyoxyalkylene derivative component of the fabric softening composition thereof is the adduct of a fatty acid mixture containing at least 65 percent of $C_{18}$ fatty acid and 2.5 moles of a mixture of 3 parts ethylene oxide and one part propylene oxide.

27. The fabric softening article as in claim 20, wherein the polyxoalkylene derivative component of the fabric softening composition thereof is the adduct of polyethylene glycol with a molecular weight of 200 and a fatty acid mixture containing at least 55% $C_{16}$ fatty acid.

28. The fabric softening article as in claim 27, wherein the polyoxyalkylene derivative component of the fabric softening composition thereof is present at 55% by weight.

29. The fabric softening article as in claim 27, wherein the polyoxyalkylene derivative component of the fabric softening composition thereof is present at 50% by weight.

* * * * *

UNITED STATES PATENT AND TRADEMARK OFFICE

CERTIFICATE OF CORRECTION

PATENT NO. : 4,906,410

DATED : March 6, 1990

INVENTOR(S) : Philip Lacke, et al.

It is certified that error appears in the above-identified patent and that said Letters Patent is hereby corrected as shown below:

Column 9, line 58: "inventioon" should read as --invention--

Column 12, line 6, Claim 19: "methosulate" should read as --methosulfate--

Signed and Sealed this

Ninth Day of July, 1991

*Attest:*

*Attesting Officer*

HARRY F. MANBECK, JR.

*Commissioner of Patents and Trademarks*